United States Patent [19]

Gallagher et al.

[11] 4,080,878

[45] Mar. 28, 1978

[54] APPARATUS FOR FORMING A STRIPABLE BACKING MATERIAL FOR PRESSURE-SENSITIVE ADHESIVE CARRYING SUBSTRATES

[75] Inventors: Nicholas D. Gallagher; Richard L. Gibbs, both of Troy, Ohio

[73] Assignee: The Brown-Bridge Mills Inc., Troy, Ohio

[21] Appl. No.: 756,786

[22] Filed: Jan. 5, 1977

[51] Int. Cl.[2] ..... B31B 1/25

[52] U.S. Cl. ..... 93/58 ST; 425/363; 425/385; 425/369

[58] Field of Search ..... 83/6, 8, 7, 12; 425/363, 369, 396, 385; 93/58.1, 58.2 R, 58 R, 58 ST

[56] References Cited

U.S. PATENT DOCUMENTS

| | | | |
|---|---|---|---|
| 1,798,475 | 3/1931 | Lange | 93/58.2 R |
| 3,041,669 | 7/1962 | Marshall | 425/292 |
| 3,292,513 | 12/1966 | Palmer | 83/8 X |
| 3,359,773 | 12/1967 | Stuchberg | 83/6 X |
| 3,526,566 | 9/1970 | McDvain, Jr. et al. | 93/58 ST X |
| 3,719,548 | 3/1973 | Keck et al. | 83/12 X |
| 3,728,980 | 4/1973 | Fraze | 83/6 X |
| 3,977,310 | 8/1976 | Keck et al. | 93/58 ST |

*Primary Examiner*—Robert L. Spicer, Jr.
*Attorney, Agent, or Firm*—Biebel, French & Nauman

[57] ABSTRACT

A method and apparatus for forming a compression scored release liner for use with a face stock carrying a pressure sensitive adhesive. The apparatus comprising a generally cylindrical roller having a generally semi-circular cross sectioned rib extending entirely around the surface of the roller concentric therewith, a pair of adjacent recesses forming relief areas extending entirely around the roller on either side of the rib, and a pair of lands each extending outwardly from the relief areas and forming the remaining cylindrical surface of the roller. The roller to compression scores the surface of a release liner in a controlled manner even though the thickness of the liner may vary, by providing relief areas and lands adjacent thereto on each side of the compression scoring rib so that excess material can be displaced from the scoring region in order to maintain uniform density of the liner in the scored region and prevent the rib from completely cutting through the liner.

16 Claims, 5 Drawing Figures

PRIOR ART

APPARATUS FOR FORMING A STRIPABLE BACKING MATERIAL FOR PRESSURE-SENSITIVE ADHESIVE CARRYING SUBSTRATES

BACKGROUND OF THE INVENTION

1. FIELD OF THE INVENTION

The present invention relates to release liners for pressure-sensitive adhesive carrying substrates, and more particularly, to a method and apparatus for forming a compression scored release liner to permit the liner to be easily removed from the adhesive carrying substrates.

2. PRIOR ART

Many apparatus and methods have been devised for continuously or intermittently scoring a release liner for use with adhesive carrying substrates in order to permit the liner to be easily removed from the substrate immediately prior to its being used. Such apparatus generally utilize a roller which is secured to existing machinery for performing an auxilliary operation, or is used in a separate operation in the series of steps required to produce adhesive carrying substrates removably secured to a liner. This is most often accomplished in a continuous process in which a web of liner is first scored and then assembled with adhesive and substrate, and the assembly is then cut to the desired dimensions of individual sheets or left in roll form. It is desirable that the scoring of the release liner does not produce a slit or cut entirely through the liner, since it would permit adhesive to seep into or through the liner.

The industry terms such release liners as "splitless" release liners. Early examples of such release liners are shown in Starr (U.S. Pat. No. 2,319,272) and Brady (U.S. Pat. Nos. 2,434,545 and 2,681,732). These patents disclose using abrading means or scoring means to reduce the cross-sectional area at the score line. Another patent which discloses a crushing-cutting rotary tool to form a scored liner is Karn U.S. Pat. No. 3,230,649. In Karn the scored areas are disrupted, evidently in order to guarantee the integrity of the liner prior to cracking along the score line.

A specific apparatus for forming such an interrupted score line is shown in Morgan U.S. Pat. Nos. 3,570,337 and 3,900,654. That apparatus utilizes a long cylindrical roller provided with a spirally wound wire or series of wires secured to the surface of the cylinder with intermittently relieved portions which cause intermittent scoring or cutting of the liner as the device is rolled over the surface of the liner.

It should be noted that devices of this nature are driven by contact with the web rather than by independent drive means due to the angular contact of the spirally wound wire with the web. The web is usually passed between the scoring roller and a separate parallel roller disposed beneath the web for supporting the liner as the roller compresses the material of the liner in the region being scored. This arrangement generally provides sufficient frictional engagement between the scoring roller and the liner to provide sufficient driving force for rotating a scoring roller without auxilliary means.

One difficulty associated with this type of prior art device is that the wire which is spirally wound around the cylindrical roller occasionally breaks or is otherwise damaged. This requires the shutting down of the entire machine, since the wire extends the length of the roller and thus will no longer score the liner at the proper locations along the width of the web.

An alternative to such a device is suggested by U.S. Pat. Nos. 3,719,548 to Keck and 3,859,157 to Morgan in which a cylindrical roller is disclosed with scoring ribs secured to the surface of the cylindrical roller concentric therewith. This permits continuous scoring of the liner. Again, the possibility exists of damaging the scoring ribs which would require machine shut down and remachining of the cylinder.

In Keck, individual rolls are suggested. The advantage of this particular construction is that a plurality of these scoring rollers may be utilized on a common axis of rotation extending across the web, so that if a single roller becomes defective the remaining rollers will score the web at the desired location. In addition, it is not necessary to replace the entire scoring roller assembly since a single element may be quickly replaced at substantially reduced cost as compared to those scoring rollers which are a single element extending across the entire web.

The Keck type of device also utilizes a pair of spaced resilient members disposed on each side of the scoring rib in spaced relation thereto and concentric therewith, for the purpose of maintaining frictional engagement with the web in order to rotate the roller by contact with the web without the use of auxilliary means.

However, such a device causes lack of uniformity in the scoring depth in the liner due to nonuniformity in the liner thickness and to wear of the resilient members over extended periods of use. This lack of uniformity can create undesirable defects in the release liner such as causing score lines which are either too deep and actually result in slitting of the release liner entirely through, or are too shallow resulting in a release liner which will not fracture in the desired manner when bent.

SUMMARY OF THE INVENTION

The present invention overcomes the difficulties and disadvantages associated with prior art devices, by providing a compression scoring roller which will maintain uniformity of the depth of compression scoring of the release liner, and a plurality of which can be used on a common axis to compression score the width of a web so that individual elements may be replaced without replacing the entire bank of compression scoring rollers.

These advantages are accomplished by the use of a compression scoring roller having a generally cylindrical configuration with a generally semi-circular cross section rib extending entirely around the surface of the compression scoring roller concentric therewith, a relieved area on either side of the rib, and cylindrical, rigid lands extending outwardly from each relieved area for positive engagement with the surface of the liner to be compression scored. The scoring tool is operated on and accordingly, the compression score line is imparted to the side of the liner opposite to the release coating.

An important feature of the invention is the provision of relief areas on each side of the compression scoring rib. These relief areas permit expansion of the liner material immediately adjacent the region in which the material is being compression scored. By providing such relieved portions, variations in material thickness may be compensated for by having the additional thickness of material forced into the relieved areas adjacent the compression scoring rib, while the rigid lands extending outwardly from the relieved areas contact and tend to compress the liner and prevent the effect of the compression liner being impressed too deeply as to result in the slitting through of the release liner.

This is a substantial advantage over the resilient rib type friction member of the type described above, since the resilient rib will further compress due to an increase in thickness of the liner, thus reducing the depth of the open space between the scoring rib and the resilient rib which causes undesirable variations in the compression of the material in the scoring region, since material flow out of the scoring region is inhibited if the relief area is not sufficient to permit unrestricted flow of material away from the scoring region. This lack of uniformity in compression of material in the scoring region results in a fluctuation in tensile strength in the region and can result in slitting of the material rather than scoring. If too much material is compressed in the scoring region it becomes embrittled, causing premature fracturing of the material in the scoring region upon handling, which is clearly undesirable.

It is an object of the present invention to provide a novel means for compression scoring a release liner for use with a face stock carrying a pressure sensitive adhesive.

Still other and further objects of the present invention will be obvious from the following description of the preferred embodiment and the appended claims.

DETAILED DESCRIPTION OF THE PREFERRRED EMBODIMENT

Figure 1:
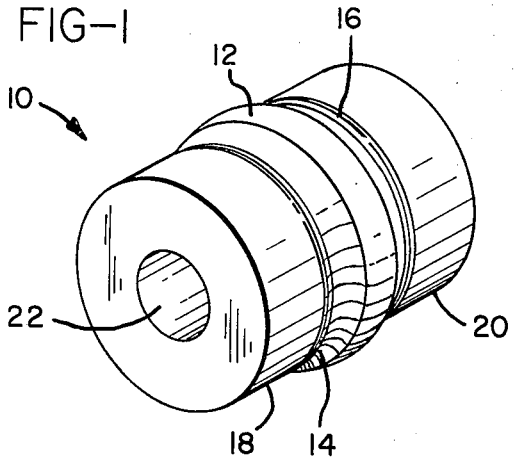
FIG. 1 is a pictorial view of a preferred embodiment of the present invention.

The preferred embodiment of the compression scoring member 10 is illustrated in FIG. 1 as having a generally cylindrical configuration with a central compression scoring rib 12 of generally semi-circular cross section; a pair of recesses 14 and 16 on either side of the rib 12 providing an opening of generally semi-circular cross section; and a pair of cylindrical lands 18 and 20 extending outwardly from the recesses 14 and 16, respectively. A cylindrical opening 22 is provided concentric with the axis of rotation of compression scoring member 10 in order to mount the compression scoring member for use in a manner described below.

Figure 2:
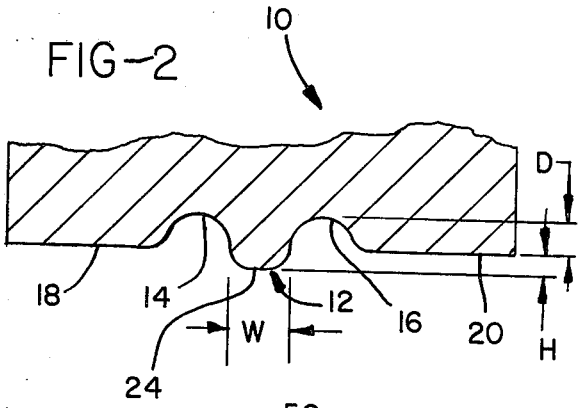
FIG. 2 is a cross sectional view of a portion of the embodiment of FIG. 1 in a plane through the axis of the embodiment, illustrating the rib, relief areas and lands.

Referring to FIG. 2, the compression scoring member is preferably made of steel or other relatively incompressible rigid material. It can be machined from a solid cylindrical member or cast with the generally desired configuration and then machined to the proper dimensions. In any event, the rib 12 is preferably radiused at its outer working face 24 with a radius in the range of about 10 to 30 times the caliper of the release liner to be compression scored so that it does not have such a sharply radiused working face that cuts it through the release liner rather than compresses it. Also, for the same reasons, the width W of the rib adjacent the working face 24 is preferably about 50 percent of the radius of the face.

Obviously, the rib 12 must extend beyond the radial dimension of the lands, and it is preferable that the radial extension of the rib from the axis of rotation of the compression scoring member 10 is in the range of about 60 to 90 percent of the caliper of the release liner to be compression scored, greater than the radial extension of the land. In other words, the height H of the working face 24 relative to the lands 18 and 20 should be approximately 60 to 90 percent of the caliper, i.e., thickness, of the release liner to be scored. Thus, it can be seen that the lands 18 and 20 will always contact the release liner being compression scored and provide the frictional engagement necessary to drive the compression scoring member 10 by engagement with the web.

The recesses 14 and 16 may extend substantially into the body of the compression scoring member 10, since what is important is that sufficient recess be provided to permit the material adjacent the rib 12 to expand into the recesses without restriction. However, as a minimum it is preferred that the recess depth D constitute approximately 50 percent of the height of the rib 12 and that the distance H be approximately the remaining 50 percent of the height of the rib relative to the surface of the lands 18 and 20.

Figure 3:
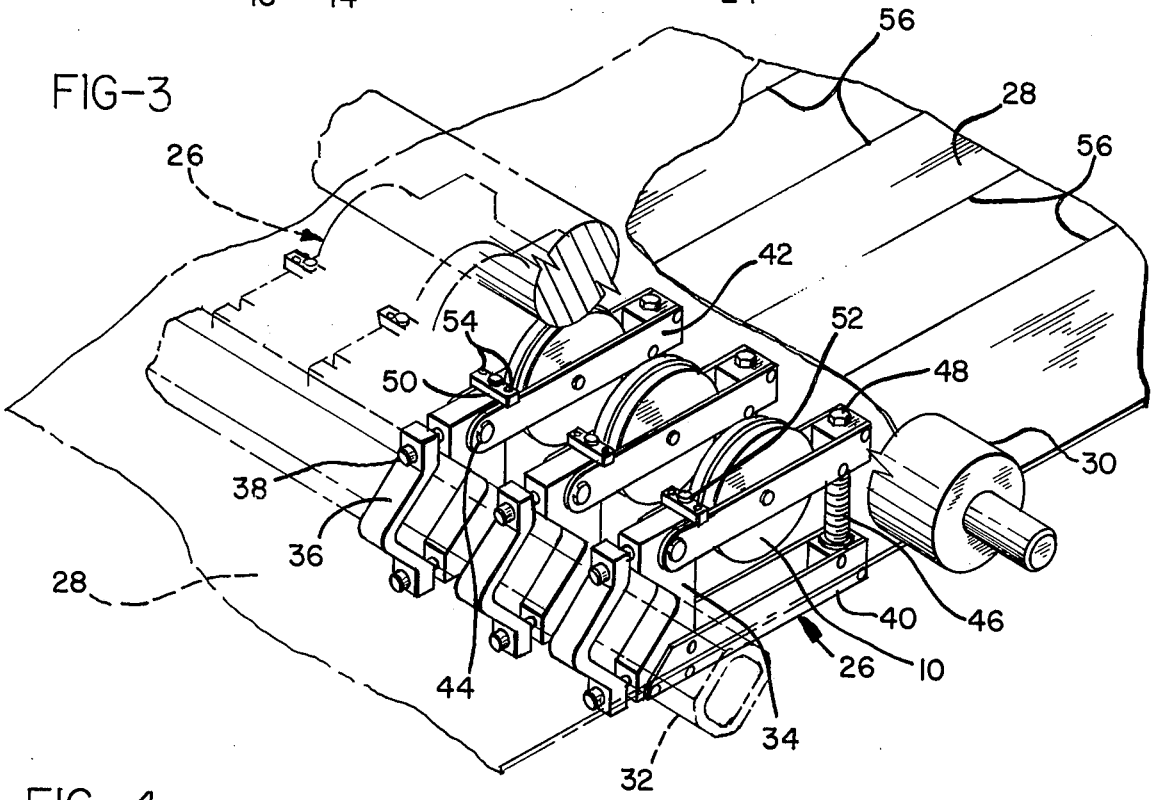
FIG. 3 is a pictorial view illustrating a plurality of the preferred embodiment of FIG. 1, and a support roller beneath the web.

Referring to FIG. 3, in use a plurality of the scoring members 10 are mounted for independent rotation and supported by individual frame structures 26 across the width of a web 28 of material to be compression scored. On the opposite side of the web 28 from the compression scoring members 10 is a support roll 30 disposed for rotation about an axis parallel to the axis of rotation of the scoring members 10. The roller 30 could, if desired, be composed of a plurality of individual rollers in alignment with each of the compression scoring members 10. However, in view of the adjustability of the individual supporting frames 26 for the individual compression scoring members 10, as is described in detail below, this is not necessary. The support roller 30 supports the web 28 at the points where the compression scoring members 10 will score the web as it passes beneath the plurality of compression scoring members.

Each of the compression scoring members support frames 26 is mounted to a rectangular bar 32 rigidly secured to the frame structure of the machine (not shown). The frame 26 is secured to the rectangular bar 32 by means of the rectangular opening formed between the opening in end 34 of the frame structure 26, and a closing bracket 36 which is secured to the end of the frame by bolts 38. This permits the individual frames 26 to be moved laterally along the rectangular bar 32 to properly position them properly above the web to produce the desired distance between adjacent compression scoring members 10.

Extending outwardly from the bottom of end 34 of the compression scoring member support frame 26 is a rigid arm 40, and extending outwardly from the top of end 34 is an arm 42 pivotally connected to end 34 by pin 44. A compression spring 46 extends between the rigid arm 40 and movable arm 42 remote from end 34 and is maintained in compression by bolt 48 which extends from arm 42 into arm 40. Bolt 48 has a smooth shank at the upper portion of the bolt which permits arm 42 to move relative to the bolt in the direction to compress spring 46. Bolt 48 and compression spring 46 provide the means for adjusting the depth of compression of the web 28 by pivoting the axis of rotation of the scoring member 10 about the pivot pin 44. This provides an excellent means of permitting individual alignment of the individual compression scoring members 10 to compensate for variations in dimensions of the scoring members.

An adjustable stop guide 50 is provided on end 34 of the frame 26 to limit the pivotal movement of arm 42. The stop guide 50 is secured to end 34 by bolt 52, and a pair of limit screws 54 are provided in alignment with each side of the frame 42 to adjust the stop position of pivotal movement of the arm 42.

Figure 4:
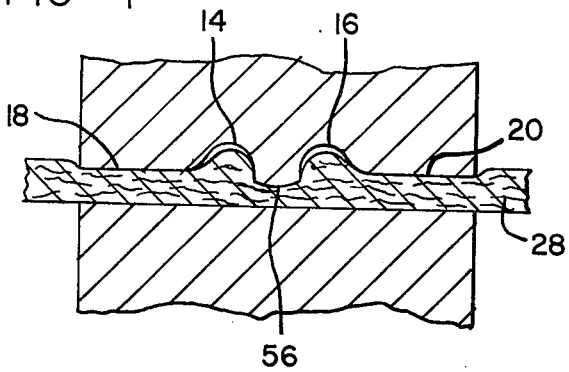
FIG. 4 is a partial cross sectional view through one of the preferred embodiment members illustrated in FIG. 2, compressing a portion of the web.

As illustrated in FIG. 4, each of the compression scoring members 10 will produce a score line 56 which is actually a compressed region in the web 28. It is preferable that this compressed score line be sufficiently deep to cause a reduction in the tensile strength of the material in the compression scored region of approximately 50 to 75 percent, in order that the material becomes sufficiently brittle that it will fracture when bent. As can be seen from FIG. 4, the material immediately adjacent the scoring region 56 is forced into the recesses 14 and 16. This aids substantially in providing the appropriate embrittlement in the scored region 56 while the adjacent land areas 18 and 20 prevent an over compression of material. Over compression of the material results in premature fracture, upon even the most gentle handling, which is undesirable.

Further, the provision of the recesses 14 and 16 permits additional material to be forced into the recesses when the thickness of web 28 increases, thus permitting essentially the same compression of material in the scoring region 56 to facilitate a uniform compression and embrittlement along the length of the scoring member even with variation in material thickness.

Figure 5:
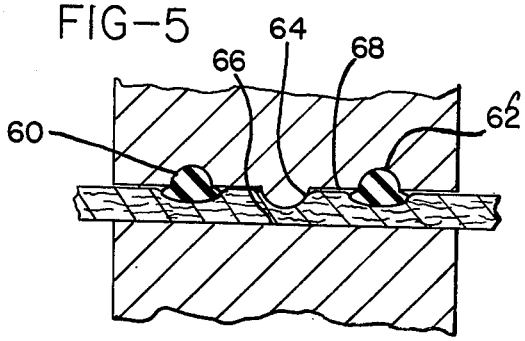
FIG. 5 is a partial cross sectional view of a prior art device shown compressing a portion of a web.

In contrast, prior art devices of the type illustrated in FIG. 5, which utilizes resilient ribs 60 and 62 disposed adjacent the scoring rib 64, do not provide complete control over the compression of the material in the scoring region. For example, if the thickness of the web increases, the resilient ribs 60 and 62 will be further compressed, thus reducing the openings 66 and 68 which would otherwise be present for permitting flow of material out of the region being scored. This lack of control can result in over embrittlement of the scored region, ultimately resulting in premature fracture of the material.

Although the foregoing illustrates the preferred embodiment of the present invention, other variations are possible. All such variations as would be obvious to one skilled in this art are intended to be included within the scope of the invention as defined by the following claims.

We claim:

1. Apparatus for forming a compression scored paper release liner for use with a face stock carrying a pressure sensitive adhesive, said liner being releasably adherable to an opposite side of said adhesive from said face stock, comprising:

a compression forming area;

means in said area for providing a rigid support surface in contact with one side of said liner as it moves through said area;

cylindrical compression means mounted for rotation on an opposite side of said liner from said support means and having a cylindrical rib of generally semi-circular cross section transverse to the direction of movement of said liner for compressing a narrow region along another side of said liner opposite said one side as said liner passes through said compression forming area;

means providing liner relief areas on each side of said narrow region in said compression forming area for allowing said liner to expand into said relief areas during compression of said region; and means providing rigid land surfaces adjacent said relief areas extending outwardly from said relief areas and at a predetermined parallel spacing from said rigid support surface.

2. Apparatus as defined in claim 1 wherein said rigid support surface means includes a generally cylindrical roller supported for rotation beneath said liner.

3. Apparatus as defined in claim 1 wherein said compression means includes said generally semi-circular cross sectioned compression rib being disposable a predetermined distance above said rigid support surface, said distance being such as to compress said narrow region of said liner sufficiently to reduce the tensile strength of said liner in said region by at least about 50 percent.

4. Apparatus as defined in claim 3 wherein said distance is such that said tensile strength is not less than about 75 percent.

5. Apparatus as defined in claim 3 wherein said relief area providing means includes generally semi-circular cross sectioned relieved portions defined in said generally cylindrical compression member having an axis of rotation parallel to said support surface, said relieved portions extending below said land surface a distance equal to or greater than said compression rib extends above said land surface.

6. Apparatus as defined in claim 1 wherein said rigid land surface providing means includes said land surfaces being generally cylindrical and mounted for rotation about their central axes in a plane parallel to said support surface.

7. Apparatus for forming a compression scored release liner for use with a face stock carrying a pressure sensitive adhesive, said liner being releasably adherable to an opposite side of said adhesive from said face stock, comprising:

a generally cylindrical compression scoring member supportable for rotation on an opposite side of said liner from a liner support member at a predetermined distance therefrom and having:

a generally semi-circular cross sectioned compression rib, relieved generally semi-circular cross sectioned portions on both sides of said rib and of lesser radial extension from the axis of rotation of said scoring member than said rib, and rigid cylindrical lands defined next to each relieved portion and extending outwardly therefrom at a predetermined parallel position relative to said support roller.

8. Apparatus as defined in claim 7 wherein a working face of said compression rib has a radius in the range of about 10 to 30 times the caliper of the liner to be scored.

9. Apparatus as defined in claim 8 wherein the width of said compression rib adjacent said working face is about 50 percent of the radius of said face.

10. Apparatus as defined in claim 9 wherein said working face of said compression rib has a radial extension from said axis of rotation of said compression scoring member in the range of about 60 to 90 percent of the caliper of the liner to be scored, greater than the radial extension of said lands.

11. Apparatus as defined in claim 10 wherein the width of each said relieved portion is in the range of about 15 to 50 percent of the radius of said working face.

12. Apparatus as defined in claim 11 wherein the minimum radial extension of said relieved portions is about 50 percent of the height of said rib less than the radial extension of said lands and said working face extends radially beyond said lands about 50 percent of the height of said rib.

13. Apparatus as defined in claim 7 wherein said compression scoring member is supported for rotation in a frame, said frame comprising:

an end member having an opening defined therein for mating engagement with a support bar disposed parallel to a liner on a liner scoring machine;

a closure bracket removably securable to said end member for fixedly securing said end member to said support bar in a desired position relative to said liner and permitting lateral movement of said frame along said bar;

a fixed arm extending outwardly from one side of said end member;

a pivotal arm extending outwardly from said end member in spaced generally parallel relation to said fixed arm and pivotally connected at one end to said end member;

a compression spring disposed between ends of said fixed and pivotal arms remote from said end member;

bolt means for maintaining said compression spring in compression and permitting said pivotal arm to move relative to said fixed arm so as to compress said compression spring while providing an adjustable limit stop for movement of said pivotal arm in the direction of extension of said compression spring; and said compression scoring member being supported by said pivotal arm for pivotal movement therewith.

14. Apparatus as defined in claim 13 wherein a plurality of said frame members are supported by said bar in spaced relation across the width of a web to be scored.

15. A method of forming a compression scored release liner for use with a face stock carrying a pressure sensitive adhesive, said liner being releasably adherable to an opposite side of said adhesive from said face stock, said method comprising the steps of:

passing said liner through a compression forming area in which the liner is movably supported by a rigid support surface on one side;

compressing a narrow elongated region along another side of said liner opposite said one side as said liner passes through said area;

providing liner relief areas on each side of said region in said compression forming area for allowing said liner to expand into said relief areas during compression of said region;

providing rigid guide surfaces adjacent said relief areas extending outwardly from said relief areas and at a predetermined parallel spacing from said rigid support surface.

16. A method as defined in claim 13 wherein said step of compressing said narrow region of said liner includes compressing said region sufficiently to reduce the tensile strength of said liner in said region by at least 50 percent.

* * * * *

UNITED STATES PATENT AND TRADEMARK OFFICE

CERTIFICATE OF CORRECTION

PATENT NO. : 4,080,878

DATED : March 28, 1978

INVENTOR(S) : Nicholas D. Gallagher & Richard L. Gibbs

It is certified that error appears in the above-identified patent and that said Letters Patent are hereby corrected as shown below:

Column 1, line 46, "3,900,654" should be --3,900,645--.

Column 4, line 55, cancel the first "properly".

Signed and Sealed this

*Fifth* Day of *September 1978*

[SEAL]

*Attest:*

RUTH C. MASON
*Attesting Officer*

DONALD W. BANNER
*Commissioner of Patents and Trademarks*

UNITED STATES PATENT AND TRADEMARK OFFICE

CERTIFICATE OF CORRECTION

PATENT NO. : 4,080,878
DATED : March 28, 1978
INVENTOR(S) : Nicholas D. Gallagher & Richard L. Gibbs It is certified that error appears in the above-identified patent and that said Letters Patent are hereby corrected as shown below:

Delete claims 15 and 16.

On the title page, after the abstract, "16 Claims" should read -- 14 Claims --.

Signed and Sealed this

*Twelfth* Day of *December 1978*

[SEAL]

*Attest:*

RUTH C. MASON
*Attesting Officer*

DONALD W. BANNER
*Commissioner of Patents and Trademarks*